United States Patent [19]

Medovar et al.

[11] 4,238,633

[45] Dec. 9, 1980

[54] ELECTROSLAG REMELTING APPARATUS FOR PRODUCING INGOTS

[76] Inventors: Boris I. Medovar, ulitsa Anri Barbjusa, 22/26, kv. 109; Rudolf S. Dubinsky, ulitsa Politekhnicheskaya, 5, kv. 209; Georgy A. Boiko, ulitsa Vladimiro-Lybedskaya, 16, kv. 106, all of Kiev; Vladimir I. Butov, ulitsa Turistov, 57, kv. 14, Chelyabinsk; Valery A. Prikhodko, bulvar Davydova, 7, kv. 158, Kiev, all of U.S.S.R.

[21] Appl. No.: 54,897

[22] Filed: Jul. 5, 1979

[51] Int. Cl.[3] ..... H05B 7/14

[52] U.S. Cl. ..... 13/9 ES; 13/18 C; 13/14

[58] Field of Search ..... 13/9, 9 ES, 18 R, 18 C, 13/14–17

[56] References Cited

U.S. PATENT DOCUMENTS

| | | | |
|---|---|---|---|
| 1,889,282 | 11/1932 | Franchini et al. | 13/18 C UX |
| 2,640,860 | 6/1953 | Herres | 13/18 C |
| 3,587,715 | 6/1971 | Holzgruber . | |
| 3,693,699 | 9/1972 | Holzgruber et al. . | |
| 3,752,896 | 8/1973 | Zimmermann et al. | 13/9 ES |
| 3,937,867 | 2/1976 | Wynne | 13/18 C |
| 4,047,555 | 9/1977 | Lamarque | 13/14 X |

FOREIGN PATENT DOCUMENTS

| | | |
|---|---|---|
| 1200278 | 7/1970 | United Kingdom . |
| 1355264 | 6/1974 | United Kingdom . |

*Primary Examiner*—Roy N. Envall, Jr.
*Attorney, Agent, or Firm*—Fleit & Jacobson

[57] ABSTRACT

An electroslag remelting apparatus for producing ingots includes a mould and an electrode feeding device comprising a lower holder with a roller feeding means and an upper holder in the form of a rotatable drum with a vertical shaft. The drum has through sockets to accommodate electrode blanks and gates to support the blanks. The electrode feeding device comprises also a means for joining together the consumable electrode and the electrode blank brought into abutting contact with the aid of said holders, which ensures continuous feed of the electrode into the mould cavity.

7 Claims, 2 Drawing Figures

ELECTROSLAG REMELTING APPARATUS FOR PRODUCING INGOTS

BACKGROUND OF THE INVENTION

1. Field of Application

The present invention relates to the field of electrometallurgy, and more specifically to the equipment for producing ingots by the electroslag remelting process.

2. Description of the Prior Art

Producing ingots, particularly large-size ones, often requires the use of several consumable electrodes. If the ingot shape prevents installation of several electrodes at a time above the slag bath surface, which is the case, e.g. when the shape calls for a narrow mouth in the mould, consumable electrodes are remelted in the mould cavity in succession, one after another. This gives rise to a problem of replacing consumable electrodes in the course of the electroslag process without interrupting its continuity.

Well known in the art as components of electroslag remelting apparatus for producing ingots are means for alternately feeding consumable electrodes into the mould cavity, comprising two swinging electrode holders, one of which during the electroslag process is disposed outside the space above the mould to enable a consumable electrode to be inserted therein, and when a consumable electrode held in another electrode holder is remelted and the resulting stub is withdrawn from the mould cavity by this holder, said first electrode holder takes the place of the latter, while the stub brought outside the mould is replaced by a new consumable electrode (see, e.g. U.K. Pat. Nos. 1,200,278, cl. B3F and 1,355,264, cl. H5H, and U.S. Pat. Nos. 3,587,715 and 3,693,699, cl. 164/252).

Replacing a consumable electrode in the mould cavity by the use of the foregoing means necessarily interrupts the electroslag process at the moment when the stub of a consumed electrode is already withdrawn from, while a new electrode is not yet introduced into the slag bath. Moreover, a new electrode inevitably cools the slag bath. All this results in upsetting the homogeneity of the ingot structure.

Such interruptions of the electroslag process can be avoided by continuously feeding a long electrode or an electrode being built up as it is consumed. Feeding an electrode of an essentially unlimited length is feasible, however, only when its cross-section is relatively small, in which case a wire wound in coils is used as the electrode, while large cross-section electrodes are from piece blanks built up in the course of remelting.

Also known in the art is an electroslag remelting apparatus for producing ingots, including a mould and an electrode feeding device mounted on a supporting stand (see U.S. Pat. No. 3,752,896, cl. 13-18, 1973). The electrode feeding device comprises a lower holder and an upper holder, disposed in succession above the mould and providing for alignment of the consumable electrode and an electrode blank, and a means for joining these, arranged between said holders.

The two holders incorporate fast-acting clamps and are mounted for a vertical movement independently of each other.

While the consumable electrode placed in the clamp of the lower holder and moved by the latter downwardly at a speed corresponding to the remelting rate is being remelted, an electrode blank is placed into the clamp of the upper holder; by the moment when the lower holder reaches its extreme lower position, the upper holder is moved downwardly till the bottom end of the electrode blank comes into abutting contact with the top end of the consumable electrode stub, whereupon these are welded together by said electrode joining means. Next, the clamp of the lower holder is loosened and the latter is moved towards the upper holder, following which the built up electrode is again clamped by the lower holder and released from the clamp of the upper holder.

In the above-described apparatus the remainder of a remelted electrode is built up rather than removed, which excludes slag bath cooling due to introduction of a new electrode. Employing different power sources for weld joining of the consumable electrode and electrode blank and for the electroslag remelting eliminates also the interruptions in the electroslag process.

Said apparatus, however, is inconvenient to operate, calls for much labour for performing the auxiliary operation, and fails to ensure safety of the attending personnel since the process of building up the consumable electrode is relatively complex and involves reciprocating movements of the holders and frequent re-clamping of the blank and electrode, which have to be carried out above an operating mould.

The constructional features of the electrode feeding device in the above-described apparatus make it impossible to automate said operation, especially when more than two electodes are required for producing an ingot.

SUMMARY OF THE INVENTION

The principal object of the present invention is to provide an electroslag remelting apparatus for producing ingots, which is economically advantageous, safe in operation, ensures building up the consumable electrode as it is consumed, and thus enables electroslag process to be conducted uninterruptedly.

Another object of the invention is to provide an electroslag remelting apparatus for producing ingots with such an electrode feeding device which assures an improved efficiency of the apparatus.

Still another object of the invention is to provide an electroslag remelting apparatus for producing ingots, wherein the consumable electrode is fed into the mould cavity automatically.

It is among the objects of the invention to simplify the construction of the electrode feeding device in the proposed apparatus.

These objects are attained by that in an electroslag remelting apparatus for producing ingots including a mould and an electrode feeding device mounted on a supporting stand and comprising a lower holder and an upper holder, disposed in succession above the mould and ensuring alignment of the consumable electrode and an electrode blank, and also comprising a means for joining these latter, arranged between said holders, according to the invention, the lower holder of the electrode feeding device comprises a roller means including at least two pairs of drive rollers for friction contact with the surface of the consumable electrode fed by the rollers into the mould cavity and the upper holder is in the form of a rotatable drum having a vertical shaft mounted on the supporting stand, through sockets to accommodate vertically oriented electrode blanks, the sockets being arranged in a circle passing through the vertical axis of symmetry of the roller feeding means of the lower holder, and gates arranged on the bottom end face of the rotatable drum and intended to support the electrode blanks in the sockets.

Such a construction of the electroslag remelting apparatus for producing ingots enables the electroslag process to be conducted uninterruptedly, building up the consumable electrode, as it is remelted, by measured-length blanks whose number in the rotatable drum of the electrode feeding device may be a multiple of the number of such blanks required to produce one ingot.

The provision of the roller feeding means in the lower holder in conjunction with the sockets and gates in the rotatable drum of the upper holder makes it possible to do without clamps for the consumable electrode and electrode blank, to dispense with the vertical movements of the holders, to reduce accordingly current leads and, as a result, to simplify the procedure of building up the consumable electrode and to ensure safety for operators.

In addition, the above-described construction of the electrode feeding device of the apparatus makes possible a complete automation of said auxiliary operation.

It is advantageous that the rotation drum be a changeable one, as this permits its loading outside the apparatus and thus shortens the intervals between remeltings.

The rotatable drum may be made in the form of a pair of horizontal disks mounted one above the other on a hub put on a vertical shaft, each of the through sockets being a pair of aligned apertures provided in said disks.

To effect an automatic feed of electrode blanks to the point of the abutting contact of each next blank with the consumable electrode, it is preferable that the electrode feeding device be provided with a detector to detect the moment of emergence of a blank from the rotatable drum, the detector being coupled to the drum rotation drive and installed approximately at the level of the gates. In addition, the electrode feeding device may incorporate a positive stop, installed on the lower holder and adapted to open one of the gates when it has been carried by the rotatable drum to the position over the consumable electrode, and a detector indicating when the electrode blank comes in contact with the consumable electrode, said detector being coupled to the means for joining these latter and mounted on the lower holder near the point of the abutting contact.

BRIEF DESCRIPTION OF THE DRAWINGS

The invention will now be explained by the description of a particular embodiment thereof with reference to the accompanying drawings, in which.

DETAILED DESCRIPTION OF THE INVENTION

Figure 1:
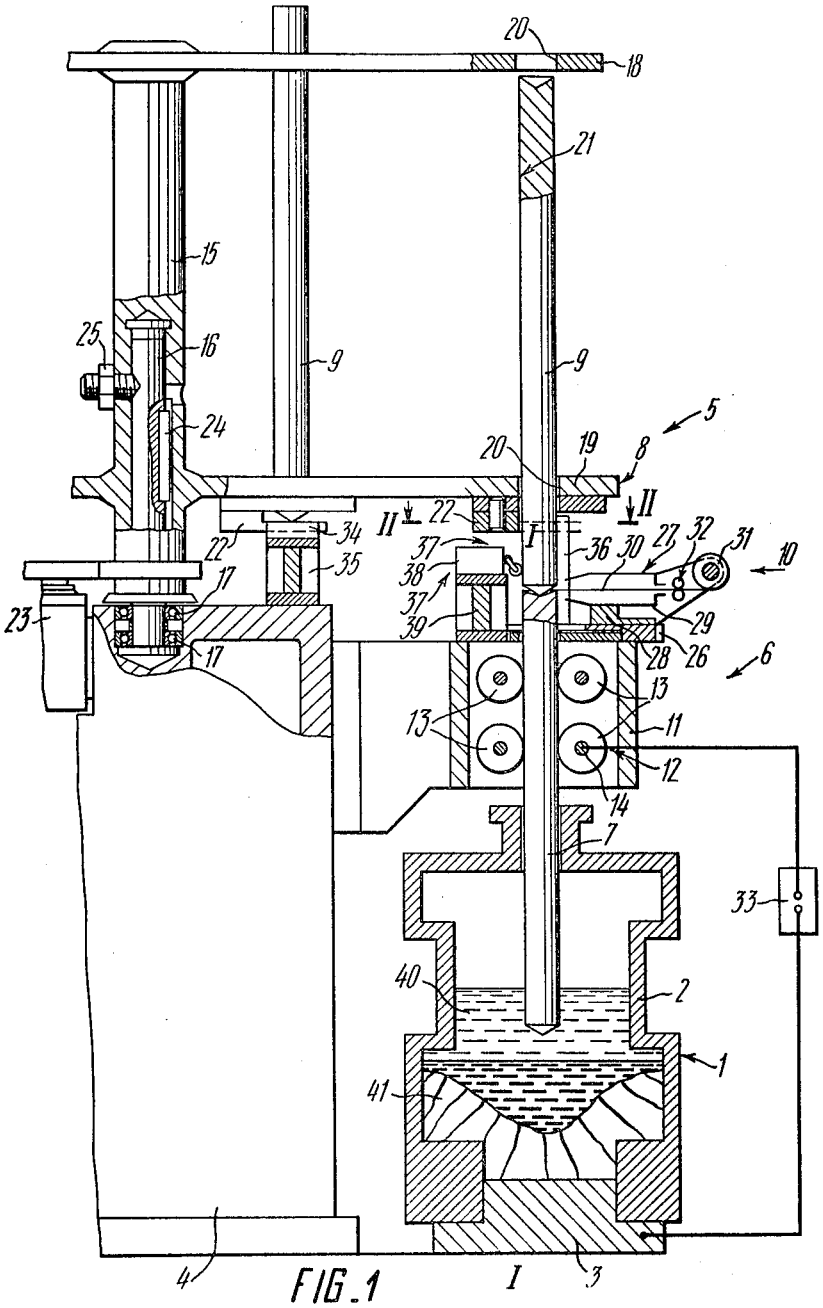
FIG. 1 shows a general view of an electroslag remelting apparatus for producing ingots according to the invention.

The electroslag remelting apparatus for producing ingots by comprises a mould 1 whose cavity confined by walls 2 and a bottom plate 3 forms a melting space for a slag bath, a metal bath, and a solidifying ingot, a supporting stand 4 installed close to the mould 1 and being a casting or weldment whose height exceeds that of the mould 1, and an electrode feeding device 5 mounted on the supporting stand 4.

The electrode feeding device 5 includes: a lower holder 6 intended for holding and guiding a consumable electrode 7 and for feeding the latter into the cavity of the mould 1; an upper holder made in the form of a rotatable drum 8 which serves as a magazine for electrode blanks 9 and is also intended for bringing one of these blanks into abutting contact with the consumable electrode 7 and holding this blank while it is being joined to the electrode; and a means for joining the electrode blank 9 to the consumable electrode 7, which means is a welding head 10, arranged between the upper and the lower holder.

The lower holder 6 comprises a horizontal bracket 11 fixedly attached to the supporting stand 4 and a roller feeding means 12 incorporating at least two pairs of drive rollers 13 carried by fixed axles 14 mounted on the horizontal bracket 11 (a roller drive is not shown). The horizontal spacing of the drive rollers 13 is selected so that they come in friction contact with the consumable electrode 7, interposed there between to effect vertical movement of the electrode from rotation of the rollers.

The drum 8 comprises a hub 15 put on a vertical shaft 16 mounted in rolling-contact bearings 17 fitted in the top portion of the supporting stand 4. The hub 15 carries an upper and a lower horizontal disks 18 and 19, fixedly attached thereto and each having apertures 20 aligned in pairs to form sockets 21 for accommodating the vertically oriented electrode blanks 9.

The diameter of the apertures 20 in the lower horizontal disk 19 is somewhat larger than that of respective aligned apertures in the upper disk 18 and exceeds the diameter of the electrode blank 9 by approximately 10% of the latter diameter; the height S of an aperture in the upper disk 18 is less than said electrode blank diameter.

One end of the electrode blank 9 is shaped as a protruding cone while the other end thereof is formed with a conical recess, the vertex angle of the protruding cone being less than that of the conical recess. With such a configuration of the blank, the above-specified relation between the dimensions of the apertures 20 of the socket 21 provides for self-centering of the electrode blank 9 on the end face of the consumable electrode 7 installed in the lower holder 6, when the blank 9 and the electrode 7 are aligned. The sockets 21 are arranged in a circle with respect to the axis of the vertical shaft 16, the circle passing through the vertical axis I—I of symmetry of the roller feeding means 12, which in this particular case coincides with the axis of symmetry of the mould 1.

The number of the sockets 21 in the drum 8 is selected equal to, or as a multiple of, the number of the electrode blanks 9 required to produce an ingot.

The lower disk 19 carries on its bottom end face gates 22 which close the sockets 21 from below and serve to support the electrode blanks 9 accommodated in the sockets.

The vertical shaft 16 is operatively connected with a drum rotation drive 23 mounted on the supporting stand 4 and comprising an electric motor, a speed reducer, and a gear pair, or being of some other conventional construction.

In the preferred embodiment of the invention described herein, the drum 8 is removable from the vertical shaft 16. To enable the transmission of torque from the shaft 16 to the drum 8, the former is fitted with a key 24. The drum 8 is provided with a retainer 25 which ensures a positive connection of the drum to the shaft 16 and prevents the drum from vibrating during its rotation.

The welding head 10 serving to join the electrode blank 9 to the consumable electrode 7 has a base 26 pivotally mounted on the horizontal bracket 11 of the lower holder 6 and made in the form of a segment gear operatively connected with a rotation drive (not shown). The pivoted base 26 carries a housing 27 comprising a post 28 and a guiding nozzle 29 through whose inner space an end of a welding wire 30 wound on a reel 31 of a welding wire feeding device 32 is passed. The inner space of the nozzle 29 communicates with a carbon dioxide feed system (not shown).

Any conventional welding head or any conventional welding method, for producing a permanent joint e.g. electroslag welding, may be used for joining an electrode blank 9 to the consumable electrode 7.

The apparatus has a power source 33 connected to the bottom plate 3 of the mould 1 and to one of the fixed axles 14 of the roller feeding means 12 of the lower holder 6.

In the preferred embodiment of the invention, the electrode feeding device 5 includes a detector 34 for detecting the moment of emergence of the electrode blank 9 from the lower disk 19 of the drum 8, the detector being a photoswitch or any other prior are device electrically coupled to the drum rotation drive 23. The detector 34 is disposed approximately at the level of the gate 22 and mounted on a support 35 fixedly attached to the supporting stand 4. The detector 34 is intended to control the rotation of the drum 8.

The same bracket 11 of the lower holder 6 carries a fixed stop 36 formed as a vertical rod and intended to open one of the gates 22. (FIG. 2) The spacing of the stop 36 from the axis of the vertical shaft 16 and from the axis of rotation of the gate 22 is selected such that the gate 22 fully opens the respective socket 21 at the moment when the drum 8 occupies the position in which the next blank 9 becomes aligned with the electrode 7 to be built up.

Operation of the welding head 10 is controlled by a detector 37 which detects abutting the electrode blank 9 against the consumable electrode 7 (FIG. 1) and is a limit switch 38 mounted on a support 39 fixedly attached to the bracket 11. The height of the support 39 is selected such that the limit switch drive is slightly above the pointed portion of the blank 9 when the latter bears against the end face of the consumable electrode 7 being built up.

The limit switch 38 is electrically coupled with the drive of pivoting motion of the welding head 10 and with the power source (not shown) of the welding head.

Before starting the remelting process or, when the drums 8 are interchangable, while the preceding ingot is being produced, the electrode blanks 9 are placed into the sockets 21 of the drum 8 so that their pointed ends rest on the gates 22. Then the drum 8 is put onto the vertical shaft 16 and locked in position by the retainer 25.

On aligning one of the blanks with the axis I—I, this blank is introduced into the cavity of the mould 1 where a slag bath 40 has been established beforehand. Next, the voltage is applied from the power source 33 to the fixed axle 14 of one of the rollers 13 of the feeding means 12 and to the bottom plate 3 of the mould 1. The heat generated in the slag by the electric current passing therethrough fuses the blank 9 introduced into the mould 1 and acting thus as the consumable electrode 7, and the molten metal flows down onto the bottom plate 3 of the mould 1 to solidify into an ingot 41.

At the moment when the roller feeding means 12, moving the consumable electrode 7 downwardly as it is fused down, withdraws its top end out of the socket 21 of the drum 8, the detector 34 switches on the drum rotation drive 23.

Figure 2:
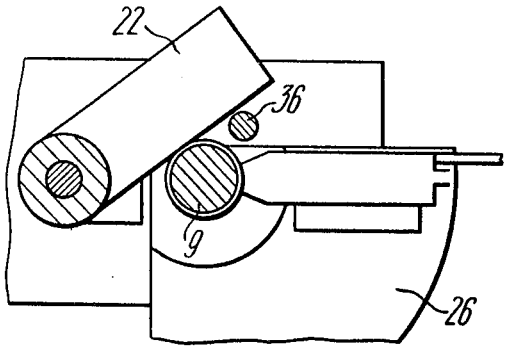
FIG. 2 is a sectional view taken along the line II—II in FIG. 1.

As the drum 8 is rotated, the gate 22 which closes the socket 21 accommodating the next blank 9 runs onto the fixed stop 36 and turns to fully open the socket 21 by the moment of aligning the blank 9 with the axis I—I (FIG. 2). Descending under gravity into abutting contact with the top end of the consumable electrode 7 (FIG. 1), the electrode blank 9 moves past the detector 34, and the latter delivers a signal to switch off the electric motor of the drive 23 and thus to stop rorating the drum 8.

The blank 9 self-centers with its pointed end in the conical recess in the end face of the consumable electrode 7, the self-centering being contributed to by the above-specified relation between the dimensions of the apertures 20 of the socket 21. As it moves towards the end face of the consumable electrode 7, the blank 9 depresses the drive element of the limit switch 38 which switches on the power source (not shown), the drive of pivoting motion of the base 26, and the welding wire feeding device 32 of the welding head 10.

The welding head 10, rotating about the axis I—I on the pivoted base 26, welds the consumable electrode 7 and the electrode blank 9 together so that the weld seam fills the gap between the surfaces of the conical point of the blank 9 and of the conical recess of the consumable electrode 7 over a greater part of the circle. Then the above devices of the welding head 10 are switched off, and the consumable electrode made longer by welding advances into the cavity of the mould 1 as one integral piece comes out of the socket 21 in the drum 8, whereupon the drum rotation drive 23 is switched on on command from the detector 34, and the drum 8 is rotated until the axis of the next electrode blank 9 is aligned with the axis I—I; then this blank 9 is brought into contact with the electrode 7 and welded thereto in the manner described above.

The above-described apparatus is most efficient for producing large ingots requiring the remelting of a great number of electrodes.

While a particular embodiment of the invention has been shown and described, various modifications thereof will be apparent to those skilled in the art.

The invention may be variously otherwise embodied without departing from its spirit and scope as defined in the claims.

What is claimed is:

1. An electroslag remelting, apparatus for producing ingots comprising:

a mould having a cavity which forms a melting space;

a supporting stand arranged close to the mould;

an electrode feeding device mounted on said supporting stand and including:

a lower holder for a consumable electrode, comprising a roller feeding means having at least two pairs of drive rollers disposed above said mould and intended for friction contact with the surface of the consumable electrode fed by said rollers into the cavity of said mould;

an upper holder for electrode blanks, which is a rotatable drum disposed above said lower holder and comprising a vertical shaft mounted on said supporting stand, through sockets to accommodate the vertically oriented electrode blanks, the sockets being arranged in a circle passing through the vertical axis of symmetry of said roller feeding means of said lower holder, and gates closing the sockets at the bottom end face of said rotatable drum and intended to support the electrode blanks in said sockets;

a means for joining together the consumable electrode and the electrode blank brought into abutting contact with the aid of said lower and upper holder, arranged between said lower and upper holder.

2. An apparatus according to claim 1, wherein said rotatable drum is changeable.

3. An apparatus according to claim 1, wherein said rotatable drum comprises a hub put on said vertical shaft and two horizontal disks mounted one above another on said hub, each of said through sockets being formed by a pair of aligned holes provided in said disks.

4. An apparatus according to claim 1, wherein said electrode feeding device includes a drive for rotation of said drum, operatively connected with the latter and mounted on said supporting stand, and a detector of the emergence of the electrode blank from said rotatable drum, coupled with said drive and installed substantially at the level of said gates.

5. An apparatus according to claim 1, wherein said electrode feeding device comprises a fixed stop adapted to open one of said gates when this gate is brought by said rotatable drum to the position of location of the consumable electrode, said stop being installed on said lower holder.

6. An apparatus according to claim 1, wherein said electrode feeding device comprises a detector of abutting of the electrode blank against the consumable electrode, coupled with said means for joining these together and mounted on said lower holder near the abutting point.

7. An electroslag remelting apparatus for producing ingots comprising:

a mould having a cavity which forms a melting space;

a supporting stand arranged close to the mould;

an electrode feeding device including:

a bracket attached to said supporting stand above said mould;

a roller feeding means mounted on said bracket and having at least two pairs of drive rollers disposed above said mould and intended for friction contact with the surface of the consumable electrode fed by said rollers into the cavity of said mould;

a rotatable drum, changeable, disposed above said roller feeding means, and comprising:

a vertical shaft mounted on said supporting stand;

a hub put on said vertical shaft;

two horizontal disks mounted one above another on said hub; each of said horizontal disks has apertures arranged in a circle, passing through the vertical axis of symmetry of said roller feeding means, in such a manner that pairs of the apertures disposed one above another form through sockets to accommodate the vertically oriented electrode blanks;

gates closing said through sockets of said rotatable drum on the drum bottom end face and intended to support the electrode blanks in the sockets;

a drive for rotation of said drum, operatively connected with the latter and mounted on said supporting stand;

a detector of the emergence of the electrode blank from said rotatable drum, with said drive for rotation of said drum and installed substantially at the level of said gates;

a fixed stop adapted to open one of said gates when this gate is brought by said rotatable drum to the position of location of the consumable electrode, said stop being installed on said bracket;

a detector of abutting of the electrode blank against the consumable electrode brought into abutting contact with the aid of said rotatable drum and roller feeding means, the detector being mounted on said bracket near the abutting point;

a means for joining together the consumable electrode and the electrode blank, said means being arranged between said roller feeding means and rotatable drum and coupled with said detector of abutting of the electrode blank against the consumable electrode.

* * * * *